United States Patent [19]

Lonati

[11] Patent Number: 4,718,253

[45] Date of Patent: Jan. 12, 1988

[54] CIRCULAR KNITTING MACHINE FOR PRODUCING STOCKINGS AND THE LIKE WITH A PROTECTIVE SCREEN IN THE PROCESSING AREA

[75] Inventor: Francesco Lonati, Brescia, Italy

[73] Assignee: Lonati S.p.A., Brescia, Italy

[21] Appl. No.: 916,901

[22] Filed: Oct. 7, 1986

[30] Foreign Application Priority Data

Oct. 14, 1985 [IT] Italy ..... 23408/85[U]

[51] Int. Cl.[4] ..... D04B 9/00; D04B 35/28; D04B 35/32

[52] U.S. Cl. ..... 66/8; 66/168

[58] Field of Search ..... 66/8, 125 K, 157, 168

[56] References Cited

U.S. PATENT DOCUMENTS 2,539,137 1/1951 Hunold ..... 66/8

3,274,803 9/1966 Schmidt ..... 66/168

3,535,895 10/1970 Krauss ..... 66/168

FOREIGN PATENT DOCUMENTS 48-2900 1/1973 Japan ..... 66/168

*Primary Examiner*—Wm. Carter Reynolds

*Attorney, Agent, or Firm*—Guido Modiano; Albert Josif

[57] ABSTRACT

The circular knitting machine has a protective screen in the processing area which comprises a containment body extending around and above the needle-bearing cylinder to define a chamber, containing the needle-bearing cylinder and being isolatable from the environment. The containment body has a lateral surface provided in at least two parts, of which at least one is movable with respect to the other for opening or closing said chamber; holes being also provided for the passage of the threads passing through the containment body for feeding the machine.

2 Claims, 3 Drawing Figures

30
15
9a
9b
5b
10
4
11
12
13
14
5a
17
16
2
7
8
3
6a
6b
19
20

CIRCULAR KNITTING MACHINE FOR PRODUCING STOCKINGS AND THE LIKE WITH A PROTECTIVE SCREEN IN THE PROCESSING AREA

BACKGROUND OF THE INVENTION

The present invention relates to a circular knitting machine for producing stockings and the like with a protective screen in the processing area.

Circular machines are known for producing stockings with protective screens in the processing zone to prevent oil, employed for the lubrication of the various devices acting on the needle-bearing cylinder and on the other elements of the machine in this region, from being spewed out of the machine onto the operators or the surrounding environment.

Generally these protection screens are composed of walls, arranged around the needle-bearing cylinder, which are higher than the needle-bearing cylinder and can be removed to allow the operator to gain access to the various elements. These walls are in transparent material, in order to allow the operator to monitor the operation of the elements of the machine in the processing region and are supported by an oil-collecting tray.

With progress in the field of circular machines for stockings with a rotating cylinder, since the speed of rotation of the cylinder is ever increasing, these known kinds of protective screen have given rise to some disadvantages.

The high speeds of the cylinder, as well as the high intervention speeds, require ever-increasing amounts of oil, which acts both as lubricant and coolant; conversely, since the centrifugal effect is ever-increasing, a great quantity of oil is spewed out from the machine and, very often, the side walls cannot offer adequate protection.

Another disadvantage is due to the noise levels of the machines during processing; in fact, the lateral walls cannot attenuate any noise, with the consequent discomfort of the operators working proximate to the machine. This problem is all the more important as the number of machines in the same room increases.

SUMMARY OF THE INVENTION

The main aim of the present invention is to provide a circular knitting machine for stockings and the like with a protective screen in the processing area which constitutes a barrier against the spewing of oil and achieves an attenuation of the noise produced by the machine.

Within the scope of the above described aim, an object of the invention is to provide a protective screen which isolates the processing area from possible infiltration of dirt from outside.

This aim, as well as this and other objects which will better appear hereinafter, are achieved by a circular knitting machine for producing stockings and the like with a protective screen in the processing area, characterized in that it comprises a containment body extending around and above the needle-bearing cylinder to define a chamber containing said needle-bearing cylinder and isolatable from the environment surrounding the machine, said containment body having a lateral surface provided in at least two parts of which at least one is movable with respect to the other for opening or closing said chamber, means being provided for the passage of threads passing through said containment body for feeding the machine.

BRIEF DESCRIPTION OF THE DRAWINGS

Further characteristics and advantages will become apparent from the detailed description of a machine with protective screen, according to the invention, illustrated by way of non-limitative example in the accompanying drawings, where.

DESCRIPTION OF THE PREFERRED EMBODIMENTS

Figure 3:
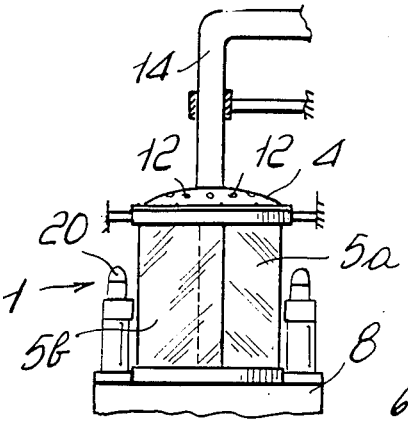
FIG. 3 is a lateral elevation view of the top part of the machine according to the invention, illustrating the protective screen in its entirety.
Figure 1:
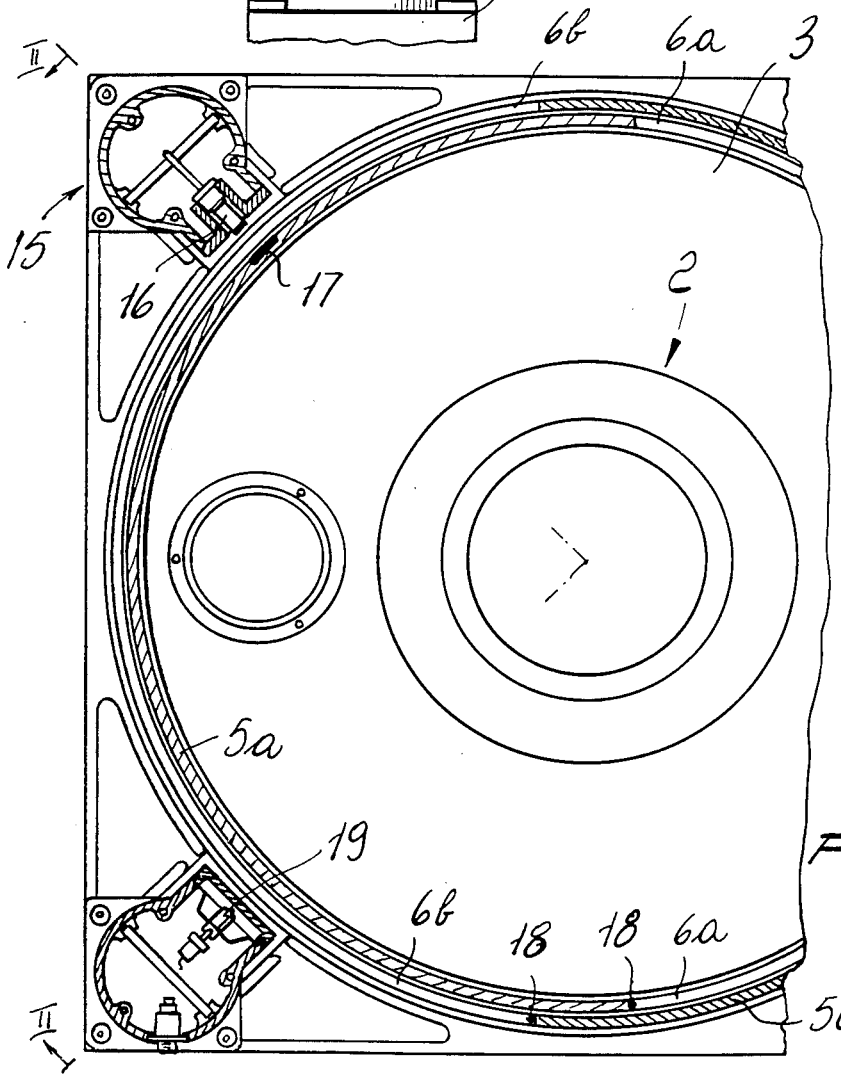
FIG. 1 is a cross section of a part of the machine according to the invention as taken along a plane extending perpendicular to the axis of the needle-bearing cylinder in the processing area.
Figure 2:
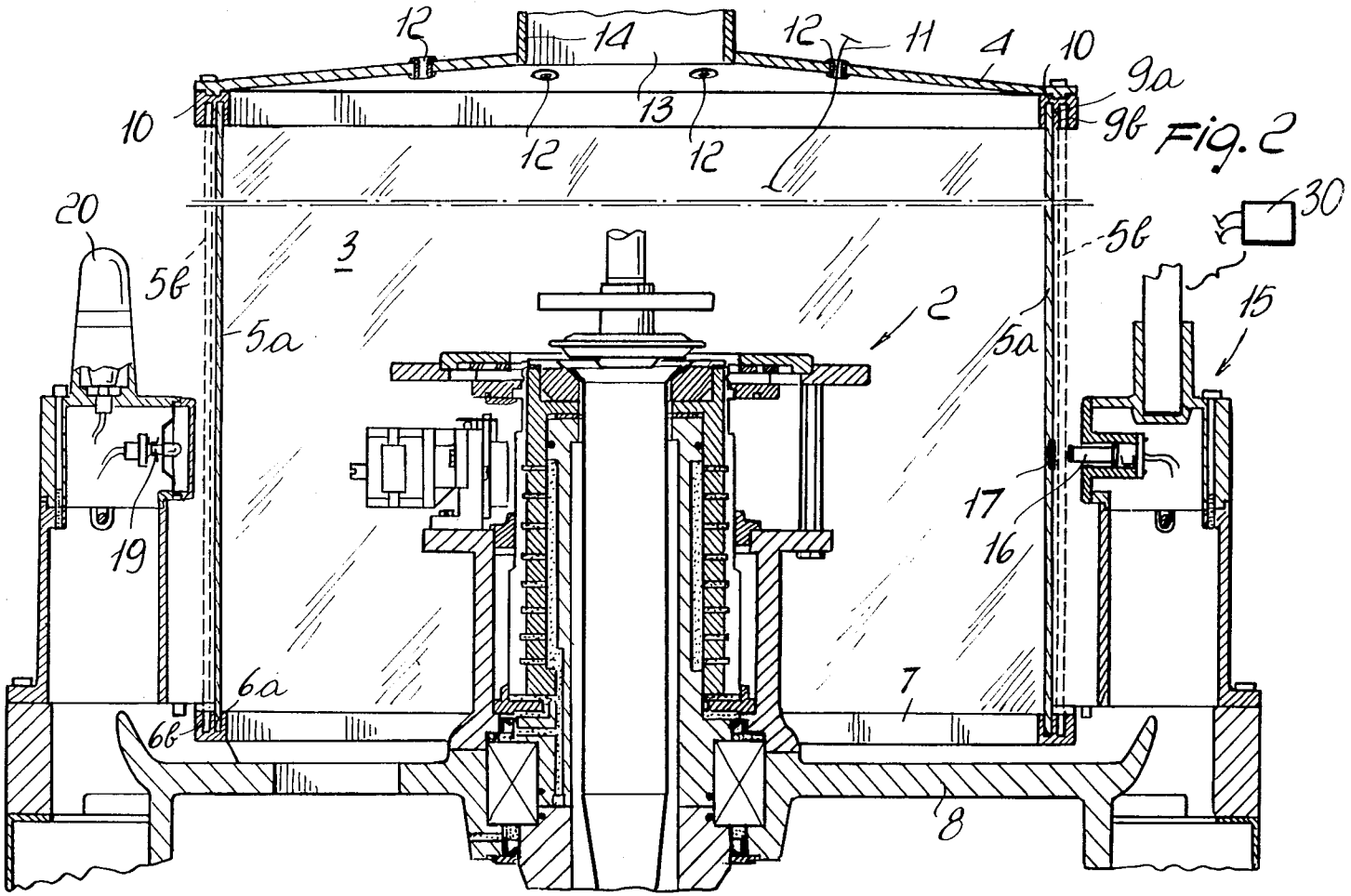
FIG.2 is a cross sectional view taken along the line II—II of FIG. 1.

With reference to the above described drawings, the machine for producing stockings and the like, according to the invention, of which, for the sake of clarity, only the top part is illustrated, comprises a containment body in transparent material, generally designated with the reference numeral 1, which extends around and above the needle-bearing cylinder 2 so as to define a chamber 3 which indeed contains the needle-bearing cylinder and is isolated from the environment surrounding the machine.

The containment body 1 has a lateral surface, substantially in the shape of a cylinder, upwardly covered by a roof 4 which, in the illustrated embodiment, is slightly conical, but may also be plane, dome-shaped, etc.

According to the invention the lateral surface of the containment body is made of at least two parts **5*a* and 5*b* of which at least one is slideable with respect to the other to open and close the chamber 3**.

More in detail, the parts **5*a* and 5*b*** substantially correspond to a half cylinder cut along a plane containing the axis and have curvature radii slightly different from one another so that one can slide superimposing itself on the other by rotating around the axis of the cylinder.

The lower and upper ends of parts **5*a* and 5*b* are slideable within guiding means composed of a pair of lower grooves 6*a* and 6*b*, which are defined in a first ring 7 associated with the supporting frame of the machine above the oil-collecting tray 8, and of a pair of upper grooves 9*a* and 9*b* which are defined on a second ring 10 which can be associated with the supporting structure of the machine or with the lower edge of the roof 4**.

Each pair of grooves is composed of two grooves extending coaxially to the containment body along circular paths with curvature radii which are slightly different from one another so as to slideably accommodate the ends of parts **5*a* and 5*b* which in this mannner are rotatable around a same axis, but with opposite directions of rotation, to obtain the opening or the closing of the chamber 3**.

According to the invention, means are provided for the passage of the threads 11 which from the spools reach the various feeds of the machine. These means are composed of a plurality of holes 12 which traverse the roof 4 of the containment body 1. In order to prevent the threads from cutting the edges of the holes due to the high operating speeds of the machine, with the consequent breakage of the thread, it can be arranged to coat the edge of the holes with anti-wear material, such as ceramic material.

The roof 4 can furthermore be provided with an opening 13 which, through a conduit 14, connects the chamber 3 with an area remote with respect to the machine, such as, e.g., the outside of the room in which the machine is arranged. By placing on this conduit an aspiration device, not illustrated in the figures for the sake of clarity, an aspirating current can be created in the chamber, which removes pieces of thread, or more generally dirt accidentally penetrated inside the chamber 3, so as to always keep the processing area clean.

Furthermore, a locking device 15 can be provided, mounted laterally with respect to the containment body 1 and composed of a magnetic-field detector 16 associated with the supporting strucure of the machine and of a plate 17 in ferromagnetic material associated with one of the parts 5*a* or 5*b* so that, with the chamber 3 closed, the plate 17 faces the magnetic-field detector. The magnetic-field detector is connected in a known manner to the main switch 30 of the machine so that, with the chamber 3 open, it is not possible to activate the machine.

For completeness of description, it should be added that in the grooves 6*a* and 6*b* detents or stop elements 18 can be provided, e.g. of the ball-and-spring type, to indicate the perfect closing of the chamber 3.

Laterally to the containment body, a lamp 19 can also be provided in a known manner for illuminating the processing area, as well as a machine halt indicator 20.

It should be furthermore added that between parts 5*a* and 5*b* it is appropriate to allow a gap for the passage of air so as to avoid a depression in the chamber 3 in order to avoid interference with the operation of the machine.

In practice, it has been observed that the containment body according to the invention fully achieves the intended aim by providing a protective screen which prevents oil from being spewed out from the machine and at the same time attenuates the noise of the machine.

Another advantage, originating from the fact that the chamber thus defined can be connected to an aspirator, is that the processing area of the machine is kept clean.

A not least advantage is that the moving parts of the machine are enclosed in the containment body according to the invention and that the activation of the machine is prevented when the containment body is not completely closed, to the full advantage of the safety of the operator.

In practice, any materials and dimensions, may be employed according to the requirements and to the state of the art.

I claim:

1. Circular knitting machine for producing stockings and the like, including a protective screen in the processing area, wherein the protective screen is comprised of a containment body extending around and above a needle-bearing cylinder to define a chamber containing said needle-bearing cylinder and isolatable from the environment surrounding the machine, said containment body having a lateral surface made of at least two parts, of which at least one is movable with respect to the other for opening or closing said chamber, and including means for the passage of threads passing through said containment body for feeding the machine and a locking device, for detecting the opening or the closing of said chamber, said locking device being connected to a main switch of the machine.

2. Machine according to claim 1, characterized in that said locking device comprises a magnetic-field variation detector associated with the supporting structure of the machine, said detector facing a ferromagnetic plate associated with one of said two parts with said chamber closed.

* * * * *